US006520119B1

(12) United States Patent
Johnson

(10) Patent No.: US 6,520,119 B1
(45) Date of Patent: Feb. 18, 2003

(54) CONVERTIBLE HORSE JUMP STANDARD WITH SLIDE IN JUMP SHELF

(76) Inventor: Barrie L. Johnson, 16 Webbs Mills Rd., Raymond, ME (US) 04071

( * ) Notice: Subject to any disclaimer, the term of this patent is extended or adjusted under 35 U.S.C. 154(b) by 0 days.

(21) Appl. No.: 10/078,736

(22) Filed: Feb. 19, 2002

Related U.S. Application Data

(60) Provisional application No. 60/271,098, filed on Feb. 24, 2001.

(51) Int. Cl.[7] ..... A01K 15/02; A63K 3/04

(52) U.S. Cl. ..... 119/705

(58) Field of Search ..... 119/705; 256/67; 482/16, 17; 472/86

(56) References Cited

U.S. PATENT DOCUMENTS

| | | | | |
|---|---|---|---|---|
| 4,414,920 A | | 11/1983 | Richards et al. | |
| 4,827,873 A | | 5/1989 | Wong | |
| 4,979,725 A | * | 12/1990 | Hutchings, II et al. | 256/67 X |
| 4,989,821 A | | 2/1991 | Wong | |
| 5,924,386 A | * | 7/1999 | Lewis | 119/705 |
| 5,967,093 A | | 10/1999 | Vitt et al. | |

OTHER PUBLICATIONS

JumpsUSA, www.jumpsUSA.com, Miscellaneous Section Jan. 2002, Dover Catalogue, p. 119, 2001–2002 Littleton, MA USA Flyer 2000 Cavaletti JumpsUSA.

Coyote Run Equestrian Products, Box 7 Site 4R.R., #2 Red Deer, Alberta CA T4N FE2. www.coyoterunequestrian.com.

Baker–Mac Ltd., 1988 www.jumpkin.demon.co.uk.

Thanet Show Jumps, www.thanetshowjumps.co/uk/plastic.htm, Combi–Block.

HB Designs, Cedar Cavaletti, Dover Catalogue p. 119 2001–2002 Littleton, MA USA.

* cited by examiner

*Primary Examiner*—Robert P. Swiatek

(57) ABSTRACT

The equestrian jump pole support system is adopted for making solid jumps, knockdown jumps, or combinations. The system includes a lightweight, free standing, three sided, triangular upright, having mutual perpendicular, elongated opposing faces with one face having a plurality of circular cutout holes. The cutout holes have a volumetric size compatibly equivalent to the jump poles, permitting the poles to slide into the holes to make a solid jump. Additionally, a jump shelf, with bracket, having a volumetric size compatibly equivalent to the circular cutout holes, plug holes and provide an exterior two position support for balancing jump poles to make a knockdown jump. The free standing, triangular shape support with cutout holes and slide in jump shelf permit the system to secure a pole, or balance a pole, or the perform both functions at the same time at different heights, widths, and depths in several different styles.

11 Claims, 4 Drawing Sheets

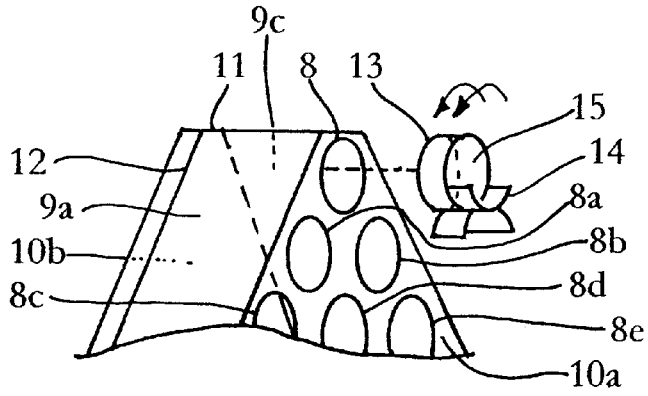
FIG. 2
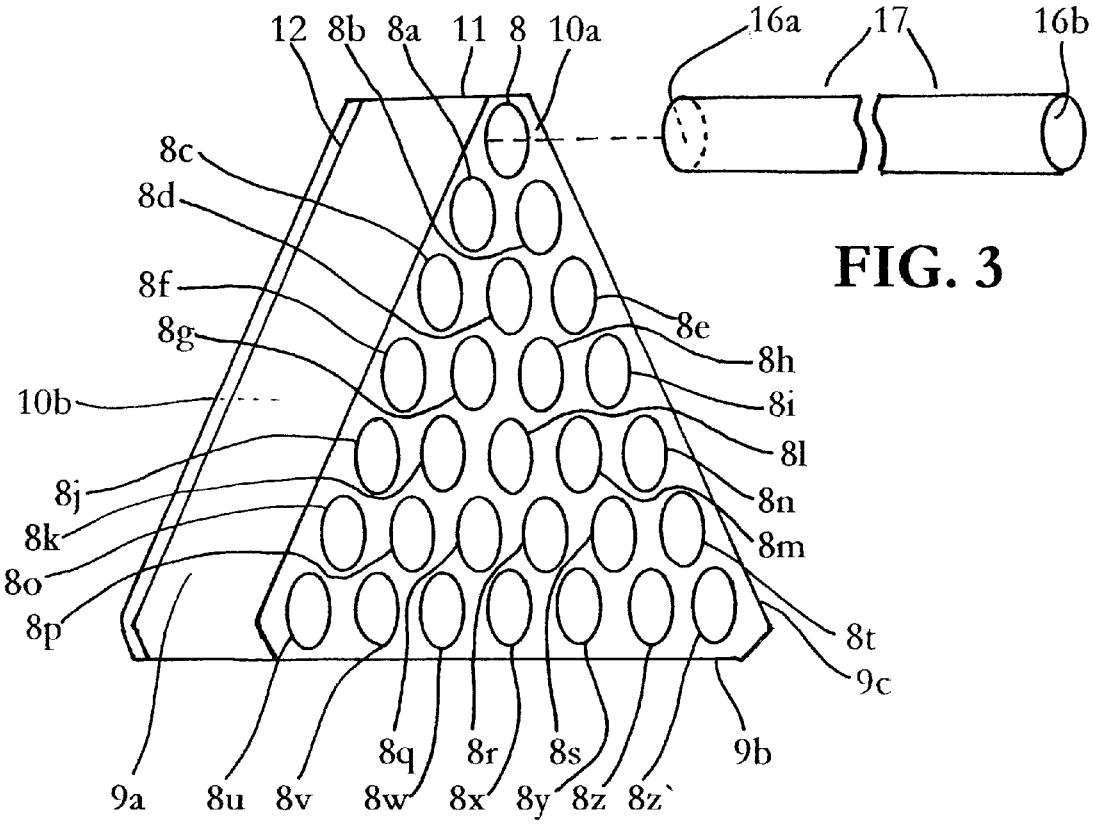
FIG. 3
FIG. 1

CONVERTIBLE HORSE JUMP STANDARD WITH SLIDE IN JUMP SHELF

CROSS-REFERENCE TO RELATED APPLICATIONS

This application is entitled to the benefit of Provisional Patent Application Ser. No. 60/271,098 filed, Feb. 24, 2001.

BACKGROUND

1. Field of Invention

This invention relates to a support for equestrian horse jump poles, specifically a support system that converts to different jump types.

2. Description of Prior Art

A jump for equestrian sports comprises generally one or more horizontally extending poles supported at each end. Horse jumps typically come in three general types; solid jumps, knockdown jumps, and combination jumps in several different styles. A solid jump is a three dimensional structure generally made with lumber or logs, nailed or screwed together in such a way that the jump is incapable of falling down or dislocated if a horse makes contact with it. A knockdown jump consists of one or more horizontally extended poles suspended and supported between two objects, such as a posts or empty barrels. The suspended poles will fall down, or dislocate when hit or run into by a jumping horse. A combination jump requires two conventional jump systems used in conjunction with each other. In other words; a solid jump with a horizontal pole suspended above by a different apparatus. In a combination jump one section will knock down if hit or run into by a jumping horse while the other section remains stationary or fixed.

Equine activities involving horse jumping, such as horse shows, eventing and stadium jumping, to name a few, use all three type of horse jumps. Solid jumps are used outdoors in fields and woods for cross-country, steeple chasing, point to points, hunter paces, fox hunting, and pleasure riding. Equine training activities called "schooling" also use all three types of horse jumps to teach a horse and/or rider how to jump and/or to prepare a horse and/or rider for the show season. The show season can be anytime an equine competition is presented. Statistically, 40,042 riders in the year 2001 rode in 280 recognized United States Combined Training Association horse events in nine different divisions and countless more rode in non-recognized events in preparation for moving up to these recognized levels. There are eleven or more different divisions in horse eventing. Each division requires the horse jumps to be a different height. Most horse trials offer at least three divisions per event. An observer or spectator who attends such horse trials will notice that there are several different styles of solid jumps scattered about the fields and woods. An observer would further notice that two or more of the same jump are built side by side at different heights to meet the requirements of a division.

In the winter where snow and ice are an issue, the cross-country courses are not used and solid jumps are too large and heavy to store or cover and are left in the fields or woods exposed to the elements.

Consequently, there exists an unsatisfied need for an adjustable light weight, durable, portable, weatherproof support, that can change jumps to different heights and depths within one unit. There is also a further need for a jump system that within one unit can change to different adjustable styles as well. It also became apparent in the search of prior art, that there exists an unsatisfied need for a support system that can serve as the real thing; in other words, serve to be a training jump as well as a show or event jump. For instance: two popular solid jumps used in horse jumping are chicken coops and roll tops. They look as their name implies and they are both solid jumps. The prior art cited, are training devices that will simulate a solid jump, but will not look like the actual product and are not used in horse shows or events. In horse jumping, visual familiarity is of key importance to the success or failure of making it over a jump obstacle safely, or at all. Practice jumps, while very helpful, do not fully prepare a horse and rider for the real thing. In searching, no prior art was found which would make a solid jump that could be used in an actual event or horse show.

U.S. Pat. No. 4,827,873 to Wong (May 9, 1989) permanently holds a pole in place so as not to be able to knock down if hit or run into by a jumping horse and therefore can not be used as a knockdown jump. U.S. Pat. No. 4,989,821 (Feb. 5, 1991) to Wong shows a continuation of his invention whereby a structure had been added to accommodate a knockdown pole suspended in a plane directly above a solid pole. The knockdown pole is adjustable, however the unit as a whole is limited to a vertical position only, offering no depth alternatives, which is necessary for training and use in cross-country events. U.S. Pat. No. 4,414,920 to Richards and Hamilton (Nov. 15, 1983) discloses a plastic block used to support a jump pole. Several blocks must be used to construct a horse jump and no construction using the block will make a solid jump. U.S. Pat. No. 5,967,093 (Oct. 19, 1999) to Vitt et al., shows a telescopic standard with a jump support capable of holding two poles at the same time, in part, for teaching a horse and rider how to jump a corner jump which is specifically designed to knock down when hit by a jumping horse, but is use for training only.

OTHER REFERENCES

Jump standards manufactured by JumpsUSA, www.jumpsUSA.com, Miscellaneous Selection January 2002 comprise a flat plastic board with holes. Coyote Run Equestrian Products, Box 7 Site 4 R.R. #2 Red Deer, Alberta CA T4N FE2 manufactures a jump standard which is a medium weight, cone shaped plastic body, with a round base, which incorporates plastic cups to support a knock down jump pole. Baker-Mac Ltd. 1988 www.jumpkin.demon.co.uk/ jumpkin.htm manufactures a jump standard similar to the product made by Coyote Run Equestrain Products. Thanet Show Jumps, www.thanetshowjumps.co.uk/plastic.htm manufactures a Combi Block to make knock down jumps. Cedar Cavaletti by HB DESIGN, Dover Saddlery catalogue page 119, 2000–2001, manufactures cedar vertical posts for holding a jump pole that will not knock down.

In conclusion, as far as I am aware, no free standing horse jump standard with or with out the use of a jump cup can convert a horse jump to different, heights, widths, depths, styles or types, quickly and easily, using ordinary horse jump poles.

SUMMARY

This invention is directed to an equine support structure capable of making horse jumps of different heights, lengths, widths or styles, quickly and easily, within one unit, using ordinary horse jump poles.

OBJECTS AND ADVANTAGES

Several objects and advantages of my convertible horse jump standard system with slide in jump shelf are:

(a) to provide a convertible jump standard made of light weight material, such as high impact plastic, that uses typical jump poles, which are common to all equine establishments involved in horse jumping, to create three general types of horse jumps; knockdown, solid and combinations, in a multitude of jump styles.

(b) to provide a jump standard that will allow the user to quickly and easily change to any one of the three general types within one unit with the use of the slide in jump shelves and ordinary horse jump poles.

(c) to provide a convertible jump standard with slide in jump shelves, whereby user can change the style, height, depth or width by simply adding or removing jump poles. All three types of horse jumps are used in eventing competitions and horse shows at various times and places during the event. Within one system, the convertible jump standard with slide in jump shelf can be adjusted to fulfill many horse show or eventing needs.

(d) to provide a convertible jump standard that is free standing so that the stability of the jump is not affected, nor relies upon any sized horizontal pole which it supports. Jump standard that needs to be held up by the horizontal pole it is supporting, will be flimsy and potentially unsafe especially if only one or two horizontal poles are being supported at a time.

(e) to provide a convertible jump standard that can easily be handled by one person. Generally it takes four (4) people to move a solid or combination jump. More often, once built the jumps are too heavy to move at all, many solid jumps are permanently attached to the ground. The added advantage of using jump poles to make solid or combination jump is that one person can move, assemble and disassemble the jump. Once the jump is no longer needed, the poles can convert to other uses such as: trotting poles or ground poles, or round pen poles or cavaletti poles.

(f) to provide a convertible jump standard, that can also be used to store jump poles by keeping them off the ground in an organized fashion with easy access.

(g) to provide a convertible jump standard system, while totally different in shape from conventional jump standards, is suitable for informal schooling, as well as formal riding competitions, such as horse shows and horse eventing.

(h) to provide a convertible jump standard system that reduces overhead. All solid jumps made with the convertible system can be moved to an indoor ring in the winter rather than remain outdoors unused exposed to the elements. Additionally, to compensate for size restrictions associated with a riding ring, one needs only to change the length of the jump poles to adjust the width of the jump, rather than having to build a new narrower solid jump for indoor use.

(i) to provide a convertible jump standard whereby flowers, brush or leaf garnish may be inserted into the confined spaces between the jump poles after the jump is assembled, to make a brush box or flower box look-a-like. Normally one would have to add a premade flower box, fill it with flowers or brush then add it to an existing horse jump to achieve the same look, at added costs.

(j) to provide a convertible jump standard capable of making a spread jump using one set of jump standards. Normally, spread jumps, those jumps that have both height and depth, have been made using two sets (total of 4) of typical jump standards. The convertible horse jump standard will make adjustable spread jumps within one set.

(k) to provide a convertible jump standard that will fit into most vehicles, including the back seat of a Chevi Cavalier. Jump poles are readily available in most riding establishments involved in horse jumping, however, jump standards are expensive and often borrowed.

(l) to provide a convertible jump standard that will stack and store easily in a minimal amount of space.

BRIEF DESCRIPTION OF THE DRAWINGS

Further objects and advantages of the present invention can be found in the detailed description of the preferred embodiments when taken in conjunction with the accompanying drawings in which:

FIG. 1 diagrammatically illustrates the convertible horse jump standard in accordance with the principles of the present invention;

FIG. 2 diagrammatically illustrates the slide-in jump shelf as it relates to FIG. 1;

FIG. 3 diagrammatically illustrates a horse jump pole as it relates to FIG. 1;

REFERENCE NUMERALS IN DRAWING

Figure 4:
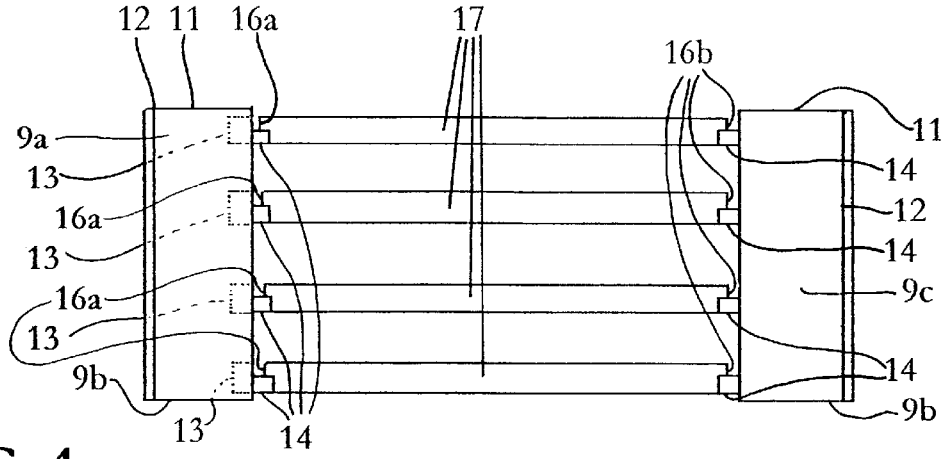
FIG. 4 diagrammatically illustrates a frontal view of a knockdown jump as seen by an approaching horse and rider.

11 jump standard
8–8*z*' holes
10*a* front face
10*b* back face
9 *a, b, c* sides
12 ridge
13 jump shelf
15 jump shelf face
14 jump shelf ledge
16*a*, 16*b* jump pole ends
17 jump pole
18 space (no jump pole)

DETAILED DESCRIPTION OF THE PREFERRED EMBODIMENTS

The present invention relates to a convertible horse jump standard system with slide in jump shelf.

FIG. 1 diagrammatically illustrates a light weight, convertible horse jump standard 11 which includes an elongated perpendicular triangular shaped face 10*a* having a plurality of circular cutout holes 8–8*z*' and an opposing perpendicular elongated triangular shape face 10*b*, which is open. The sides 9*a*, 9*b* and 9*c* are of substantial width and height to form a free standing, upright, triangular jump standard 11. The elongated, upright triangular shape is best viewed in FIG. 1. Ridge 12 runs circumferentially along the sides 9*a*, 9*b* and 9*c* of the jump standard 11 and is best shown in connection with the standard 11 when stacked for storage FIG. 7. In relation to the holes 8–8*z*', jump pole 17 with jump pole ends 16*a* and 16*b* is volumetrically compatible to the circular jump holes 8–8*z*'. This is shown in connection with FIG. 3.

FIG. 2 diagrammatically illustrates a slide in jump shelf 13. The jump shelf 13 is volumetrically compatible to the circular holes 8–8*z*'. The jump shelf ledge 14 is attached to the jump shelf face 15 of the jump shelf 13. Jump shelf ledge 14 has a high and low setting (see arrows). Insertions of the jump shelf 13 plugs the holes 8–8*z*' and serves as a bracket whereby jump pole 17 balances when jump pole 17 is suspended horizontally between two jump standards 11. This is shown in connection with FIGS. 4, 4A and FIG. 6.

FIG. 3 diagrammatically illustrates popular jump pole 17 having two opposing jump pole ends 16*a* and 16*b*. Jump pole 17 with jump pole end's 16*a* projected insertion into jump standard 11 at hole 8 and suspended horizontally over the ground with jump pole end's 16*b* projected insertion into hole 8 of an opposing jump standard 11 (not shown) to form a structure which a jumping horse can not knock down. Jump pole 17 inserted into different holes 8–8*z*' change the height, multiple pole insertions change the height FIG. 5A and width FIG. 6. Jump pole 17 with jump pole end 16*b* balancing on the jump shelf ledge 14 of the inserted jump shelf 13 and suspended horizontally over the ground with jump pole end 16*b* balancing on the jump shelf ledge 14 of the inserted jump shelf 13 of an opposing jump standard 11, form a structure which a jumping horse can knock down. Multiple use of jump shelf 13 in relation to multiple use of jump pole 17 is best shown in FIG. 4, FIG. 4A, FIG. 6.

Figure 4A:
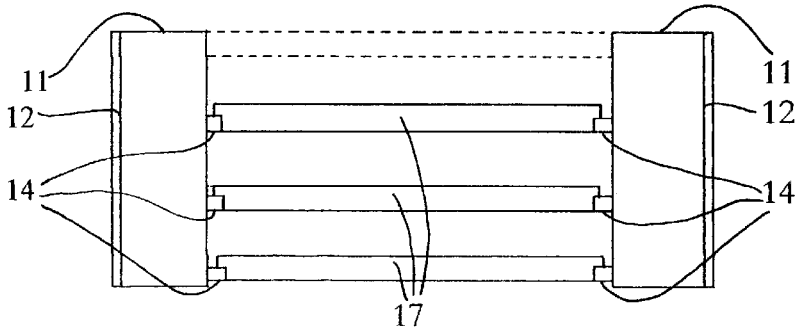
FIG. 4A diagrammatically illustrate the removal of the jump pole to change the height.

FIG. 4 diagrammatically illustrates two jump standards 11 separated by jump poles 17 with jump pole ends 16*a* balancing on the jump shelf ledge 14 of the jump shelf 13 inserted into holes 8, 8*d*, 8*l* and 8*x* of one jump standard 11 and jump pole ends 16*b* resting on the jump shelf ledge 14 of the and jump shelf 13 inserted into the holes 8, 8*d*, 8L and 8*x* of the opposing jump standard 11. Jump pole 17 is horizontally supported and suspended between each jump shelf 13 insertion FIG. 4. Jump shelf face 15 blocks the jump pole 17 from sliding into the jump standard 11 and therefore the user can be assured that the jump poles 17 will knock down if hit or run into by a jumping horse. Removal of the jump pole 17, balancing on the jump shelf 13 inserted into hole 8, will reduce the height of the structure as seen in FIG. 4A. Removal of jump pole 17, from jump shelf 13 inserted into hole 8*d*, will further reduce the height of the structure (not shown).

Figure 5:
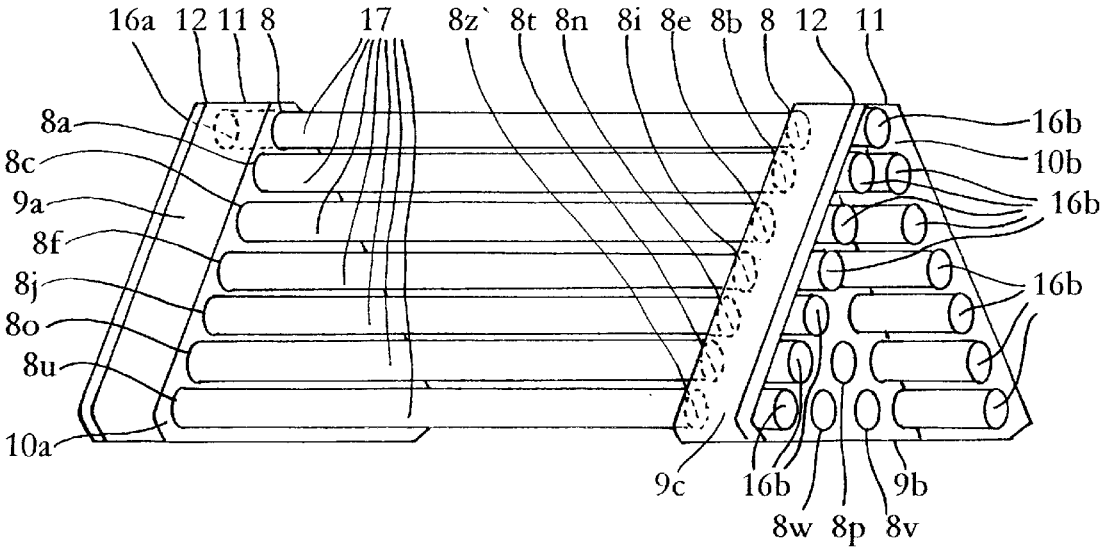
FIG. 5 diagrammatically illustrates a view of a solid jump as seen by a slightly angled approaching horse and rider.

FIG. 5 diagrammatically illustrates two jump standards 11 separated by jump pole 17 suspended and supported horizontally by insertion directly into holes 8, 8*a*, 8*c*, 8*f*, 8*j*, 8*o*, and 8*u* of one jump standard 11 without the use of jump shelf 13. This is repeated in holes 8, 8*b*, 8*e*, 8*i*, 8*n* 8*t*, and 8*z*' of the opposing jump standard 11. Properly positioned opposing jump standards 11 FIG. 4, FIG. 5 and FIG. 6 have different corresponding opposing holes 8–8*z*', with the exception of holes 8, 8*d*, 8L, and 8*x* which are positioned vertically in the center on both opposing jump standards 11. Any jump pole 17 inserted directly into the holes 8–8*z*' without the use of the jump shelf 13, forms solid jumps. Solid jumps do not move or knock down when hit by a jumping horse. It is possible to fill all the holes 8–8*z*' with jump poles 17 organized by length, circumference or color within easy access, when the user needs to organize a stack of jump poles 17. This is partially shown in FIG. 5 wherein jump poles 17, fill some of the holes 8–8*z*'.

Figure 6:
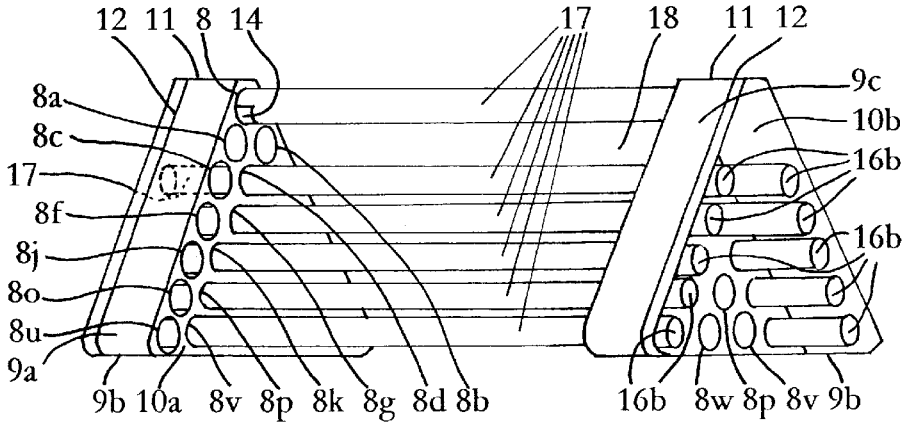
FIG. 6 diagrammatically illustrates a view of a combination jump as seen by a slightly angled approaching horse and rider.

FIG. 6. diagrammatically illustrates two opposing jump standards 11 utilizing the jump pole 17 in both a solid position and a knockdown position combined. Jump pole 17 is inserted into holes 8*d*, 8*g*, 8*k*, 8*p* and 8*v* of one jump standard 11, suspended over the ground and inserted into corresponding holes of the opposing jump standard 11 forming the solid jump. Suspended over the solid jump is a jump pole 17, which balances on the jump shelf ledge 14 of the jump shelf 13 which is inserted into the hole 8, forming the knockdown pole and creating a combination jump.

The multiple holes 8–8*z*' are positioned to allow for jump types and heights to change quickly. This is best shown by viewing FIGS. 4, 4A, FIGS. 5, 5A and FIG. 6 in relation to each other.

Figure 7:
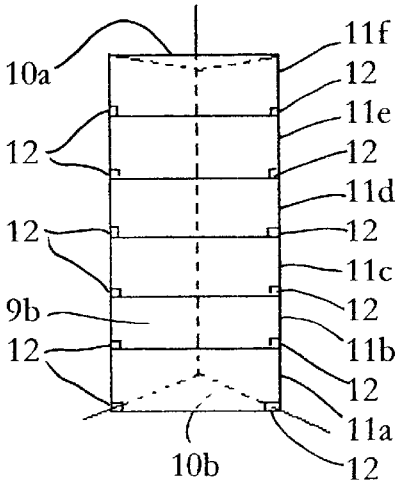
FIG. 7 diagrammatically illustrates a view of six jump standards stacked one upon another.

FIG. 7 diagrammatically shows a different view of the convertible jump standard 11 with the open face 10*b* lying flat on the ground, with the side 9*b* in full view and with standards 11*a*, 11*b*, 11*c*, 11*d*, 11*e*, and 11*f* forming a secure stack one upon the other secured by ridge 12.

Figure 8A:
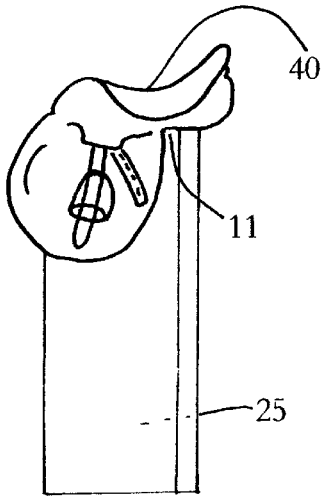
FIGS. 8A, 8B, 8C, and 8D depict several optional uses and features of the preferred embodiment of the invention as discussed below.
Figure 8B:
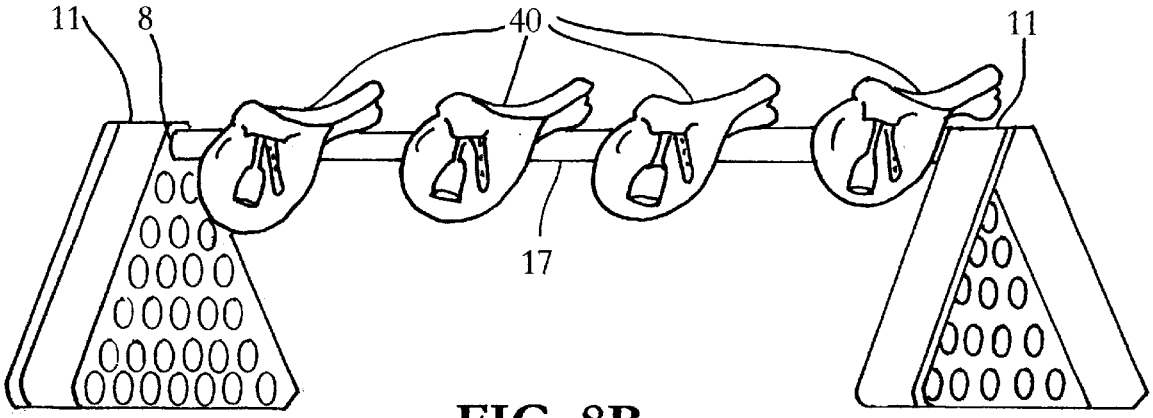
Figure 8C:
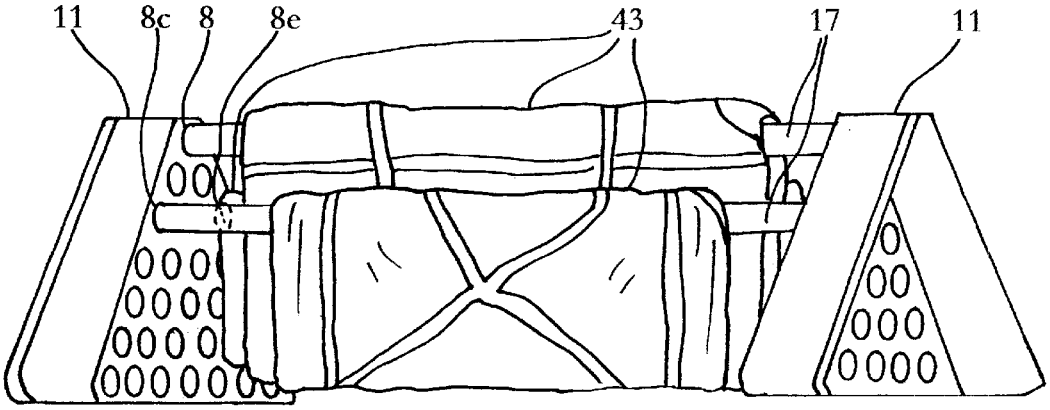

Apart from its principle use, the convertible horse jump standard has other uses, such as a saddle rack to hold a single saddle with a storage area 25 underneath, shown in FIG. 8A, or for use for several saddles 40 shown in FIG. 8B . The multiple saddle rack shown in FIG. 8B would be accomplished by taking a jump pole 17 and suspending it between the two jump standards 11 at hole 8. In addition, by adding two more jump poles at holes 8*c* and 8*e* one can make a suitable drying rack for horse blankets, horse coolers and other horse garments 43 as shown in FIG. 8C. The length of the suspended jump pole 17 determines the width of the rack and therefore, the rack can be used in any sized room or area.

Figure 8D:
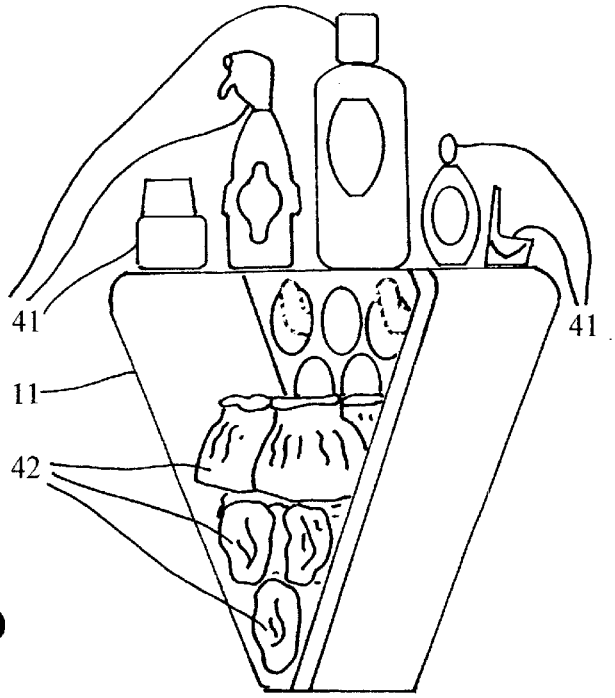

The convertible horse jump standard 11 can be used as a sturdy, steady, bench upon which to sit. The convertible horse jump standard 11 can be used to build a continuous portable fence and used any place a conventional decorative post and rail fence would be used (not shown) A single jump standard 11 can also be hung upside down on wall hooks to store and organize leg wraps 42 and medications 41 as shown in FIG. 8D. Because it is portable, the jump standard 11 can be taken to horse shows to provide a storage unit to hang on a stall door or wash stall. Inverted, the top is now a rack for medications, shampoos, and liniments with ample storage underneath for horse leg wraps, batting, bell boots, saddle pads and the likes.

Operation—FIGS. 1, 2, 3, 4, 4A, 5, 5A, 6, 7

In operation one uses the convertible horse jump standard 11 with slide in jump shelve 13 in three different ways. The user can, when needed, build a solid adjustable jump (FIG. 5). The user can, when needed, convert the solid jump to a knockdown adjustable jump (FIG. 4). The user can, when needed, make an adjustable combination horse jump (FIG .6). This invention relates to a free standing upright triangular shaped jump standard (FIG. 1) and the slide in jump shelf with ledge (FIG. 2).

The manner of using the convertible horse jump standard to make horse jumps is different to jump standards which are in present use. Namely, one can make a solid jump (FIG. 5) by inserting ordinary horse jump poles 17 into a multitude of different circular cutout holes 8–8*z*' of the free standing, upright, triangular shape jump standard 11 to form different styles of solid jumps normally used at riding stables, horse shows and horse events.

Figure 5A:
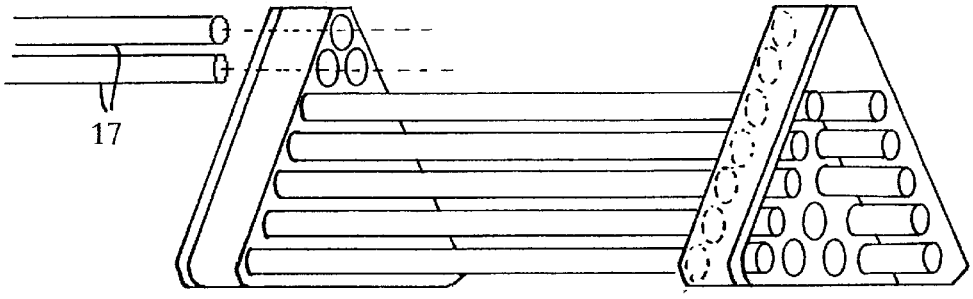
FIG. 5A diagramatically illustrates the removal of two (2) jump poles to change the height.

In operation, to build a solid jump one needs two jump standards 11 and a supply of horse jump poles 17, the number of jump poles 17 needed, depends upon the maximum height and depth the jump. The width is determined by the length of the jump poles 17. Jump standards 11 are placed so that the opposing jump pole ends 16*a* and 16*b* of the jump poles 17 can slide approximately 6 inches into the cutout holes 8–8*z*' on the front face 10*a* of the jump standard 11 the jump pole 17 is now suspended over the ground between the two jump standards 11, forming a solid jump: The user can add to the height by inserting more poles 17 into the holes 8–8z' in an ascending manner being careful not to leave a space between poles 17 where a horse could catch a hoof (FIG. 5A). Solid jumps (FIG. 5) are used on a cross-country course, steeple chasing, fox hunting, point to points, eventing, and hunter paces. Separate solid jumps of different heights are often built next to each other to accommodate the different divisions or levels found in horse eventing, however use of the present invention would accommodate different divisions with the insertion of a jump pole 17.

In operation, for safety purposes, should there be a question regarding the ability of the horse or rider, the solid jump can be made into a partial knockdown jump, called a combination jump by choosing a jump pole 17 that is approximately a foot shorter, sliding the jump shelf 13 with jump shelf ledge 14 into the jump standard 11 in an appropriate hole 8–8z' and balancing the shorter jump pole 17 on the jump shelf ledge 14. (FIG. 6). The jump shelf face 15 of the jump shelf 13 prevents the jump pole 17 from entering the circular cutout hole 8, and thus will knock down when hit or run into by a jumping horse (FIG. 6). Regarding the knock down jump pole 17; it should be placed directly over the solid section for maximum safety but may be several holes higher than the solid jump (FIG. 6) space 18.

In operation the convertible horse jump standard 11 can always be used as a conventional jump standard. (FIG. 4).

In operation referring to a knockdown jump, as show in FIG. 4, jump shelves 13 are placed in some of the holes 8–8z' to make a knockdown jump. Jump shelves 13 can be used in any of the holes 8–8z' on the convertible jump standard 11 (not shown). All jump poles 17 used in a knockdown jump must balance on the inserted jump shelves 13. All poles 17 must fall to the ground when hit or run into by a jumping horse. However, because of the triangular shape of the convertible jump standard 11, it is now possible to make a three dimensional jump that will totally knock down, by sliding the jump shelves 13 in holes 8, 8*c*, 8*j*, 8*u*, 8*e* 8*n* 8*z*' of one jump standard 11 and the proper corresponding holes 8–8z' of the other jump standard 11. Jump poles 17 are then suspended horizontally over the ground and placed on the jump shelf ledge 14 of the slide in jump shelf 13 in an inverted V shape, giving depth to the jump. This configuration can not be accomplished with conventional vertical jump standards. In operation should all the holes 8–8z' be filled with poles 17, the convertible jump standard 11 would become a jump pole storage unit (partially shown in FIG. 5). Jump poles generally weigh 12 or more pounds a piece and come in different colors, circumferences and lengths. Organizing poles with easy access by size, length or color is accomplished by removing or inserting jump poles 17 from the holes 8–8z' of the jump standard 11 (FIG. 5A). This also keeps the poles 17 from laying on the ground during storage and solves a safety issue as well. A loose stack of poles 17 can be dangerous. In most riding establishments, there are a number of jump poles 17 that are momentarily not in use: For instance, when a riding ring is being raked, when the riding ring is being use for dressage, when the riding ring is congested with group riding lessons, to name a few. During these incidences, which in may cases happen daily, jump poles 17 and jumps must be removed. The light weight convertible jump standard 11 can be removed easily and can be converted to a pole storage unit capable of holding poles 17 so that the poles will not roll over reducing the potential for injury. Further, the pole storage device mentioned above is more compact, taking up less space than a loose stack of jump poles 17.

When not in operation FIG. 7 shows the space-saving, stacking ability of the convertible jump standard 11 with the assistance of ridge 12. If the jump standards 11 are no longer needed as a jump, for instance, with the onset of winter in regions where there is snow and ice and no indoor riding ring is available, the convertible jump standard will stack to a compact, organized space saving pillar.

Conclusion, Ramifications, and Scope

Accordingly, the reader will see that the convertible horse jump standard with slide in jump shelf, can be used to make solid jumps, knockdown jumps, combination jumps, and a horse jump poles and equipment storage unit. Further, applications are performed using common horse jump poles, thus making horse jumps easy and inexpensive to make, portable and light weight to move, and adjustable in both height and depth in many different styles.

Although the description above contains many specificities, these should not be construed as limiting the scope of the invention but as merely providing illustrations of some of the presently preferred embodiments. For example, the convertible jump standard can come in different colors, can be made of wood or other materials, can be a different triangular shape, such as an isosceles triangle, can be larger or smaller, more holes can be added, or placed closer, or father apart, corners can be concave, feet can be added for extra stability, or the standard can be miniaturized for use as a toy for a child's equestrian doll house barn, with miniature horse figurines jumping in the paddock.

Thus the scope of the invention should be determined by the appended claims and their legal equivalents, rather than by the examples given.

I claim:

1. A jump shelf and a convertible horse jump standard system, said standard adopted to support the ends of equestrian jump poles, comprising:

a standard including:

a free standing triangular support;

said support comprising mutually opposing, elongated, vertical, faces, one of said faces including a plurality of circular through-ports therein; and, a jump shelf including:

a cylindrical component with attached bracket; said component having a volumetric size compatible with said circular through-ports;

wherein said through-ports having a volumetric size compatibly equivalent to said jump pole ends or said jump shelf.

2. A standard system as claimed in claim 1 wherein said support with sufficient sides as means for self support.

3. A standard system as claimed in claim 1 wherein said support having elongated faces as means for upright stance.

4. A standard system as claimed in claim 1 wherein said through-ports evenly spaced apart form a triangle.

5. A standard system as claimed in claim 1 wherein said through-ports and said jump poles having a compatible volumetric size.

6. A standard system as claimed in claim 1 wherein said through-ports have means for holding said jump poles.

7. A standard system as claimed in claim 1 wherein said through-ports having means for multiple jump pole insertions.

8. A standard system as claimed in claim 1 wherein said jump shelf plugs said through-port.

9. A standard system as claimed in claim 1 wherein said bracket extends beyond said support.

10. A standard system as claimed in claim 1 wherein said bracket having means for balancing at least one jump pole.

11. A standard system as claimed in claim 1 wherein said support, said through-ports and said jump shelf provide means for converting said jump poles from a stationary position to a non-stationary position and vice versa.

* * * * *